US008640408B2

(12) United States Patent
Wilkens

(10) Patent No.: US 8,640,408 B2
(45) Date of Patent: Feb. 4, 2014

(54) GRID SYSTEM FOR A SUSPENDED CEILING

(75) Inventor: Jan Wilkens, Höganäs (SE)

(73) Assignee: Saint-Gobain Ecophon AB, Hyllinge (SE)

( * ) Notice: Subject to any disclaimer, the term of this patent is extended or adjusted under 35 U.S.C. 154(b) by 32 days.

(21) Appl. No.: 13/326,905

(22) Filed: Dec. 15, 2011

(65) Prior Publication Data

US 2012/0159890 A1 Jun. 28, 2012

(30) Foreign Application Priority Data

Dec. 28, 2010 (EP) ..... 10197116

(51) Int. Cl.

| | |
|---|---|
| ***E04C 2/52*** | (2006.01) |
| ***E04B 2/00*** | (2006.01) |
| ***E04B 9/00*** | (2006.01) |
| ***E04B 5/10*** | (2006.01) |
| ***E04C 3/02*** | (2006.01) |
| ***E04B 1/38*** | (2006.01) |

(52) U.S. Cl.
USPC ..... 52/220.6; 52/506.05; 52/506.06; 52/647; 52/712

(58) Field of Classification Search
USPC ..... 52/220.6, 506.01, 506.05, 506.06, 52/506.07, 506.08, 506.09, 506.1, 647, 52/648.1, 650.3, 653.1, 712
See application file for complete search history.

(56) References Cited

U.S. PATENT DOCUMENTS

| | | | | | |
|---|---|---|---|---|---|
| 3,130,821 | A | * | 4/1964 | Dunlap | 403/398 |
| 3,163,266 | A | * | 12/1964 | Nels | 52/665 |
| 3,292,332 | A | * | 12/1966 | Martin | 52/506.07 |
| 3,304,684 | A | * | 2/1967 | Mock et al. | 52/665 |
| 3,310,922 | A | * | 3/1967 | Hoffmann, Jr. | 52/506.06 |
| 3,640,557 | A | * | 2/1972 | Nute et al. | 403/2 |
| 3,768,224 | A | * | 10/1973 | Curtis | 52/668 |
| 4,545,165 | A | * | 10/1985 | Carey et al. | 52/506.07 |
| 4,559,751 | A | * | 12/1985 | Rogers | 52/665 |

(Continued)

FOREIGN PATENT DOCUMENTS

| | | |
|---|---|---|
| DE | 2907914 A1 | 10/1980 |
| DE | 4118171 A1 | 12/1991 |
| SE | DE 2907914 | 10/1980 |

OTHER PUBLICATIONS

European Search Report for European Application No. EP 10197116.6.

*Primary Examiner* — Ryan Kwiecinski

(74) *Attorney, Agent, or Firm* — Harness, Dickey & Pierce, PLC

(57) ABSTRACT

The disclosure relates to a grid system including at least one main runner including an aperture; at least one cross spacer including a slot, with the slot formed from a bottom side thereof; and a fixing element. The main runner is insertable into the slot in the cross spacer from a first side of the cross spacer such that, when the main runner is inserted into said slot, the aperture of the main runner is at least partly accessible from a second side of the cross spacer, the second side being opposite to the first side. The cross spacer further includes an aperture, and the fixing element is adapted to, in a locked position, extend through the aperture in the main runner and through the aperture in the cross spacer such that the relative position of the main runner and the cross spacer is fixed.

20 Claims, 5 Drawing Sheets

(56) References Cited

U.S. PATENT DOCUMENTS

| | | | | | |
|---|---|---|---|---|---|
| 4,640,077 | A * | 2/1987 | Hall | 52/665 |
| 4,735,030 | A * | 4/1988 | Judkins | 52/506.09 |
| 4,827,687 | A * | 5/1989 | Frawley | 52/506.06 |
| 4,866,900 | A * | 9/1989 | Dunn | 52/506.07 |
| 5,475,962 | A * | 12/1995 | Horsten et al. | 52/506.08 |
| 5,482,240 | A * | 1/1996 | Caraher | 248/297.51 |
| 6,047,517 | A * | 4/2000 | Vrame | 52/506.06 |
| 7,117,650 | B2 * | 10/2006 | Dockery | 52/506.07 |
| 7,478,787 | B2 * | 1/2009 | Bankston et al. | 248/343 |
| 7,730,690 | B2 * | 6/2010 | Miller et al. | 52/506.05 |
| 2010/0095627 | A1 * | 4/2010 | Meres et al. | 52/506.07 |
| 2012/0159890 | A1 * | 6/2012 | Wilkens | 52/506.06 |

* cited by examiner

GRID SYSTEM FOR A SUSPENDED CEILING

PRIORITY STATEMENT

The present application hereby claims priority under 35 U.S.C. §119 to European Patent Application No. 10197116.6, filed on Dec. 28, 2010, the contents of which are hereby incorporated by reference in their entirety.

FIELD

At least one embodiment of the invention relates generally to a grid system for a suspended ceiling.

BACKGROUND

A grid system comprises typically a plurality of main runners extending in parallel. Ceiling tiles are typically adapted to be supported on flanges of the main runners. It is also common to add cross spacers extending over and engaging with a plurality, often three or more, main runners. The cross spacers provide structural stability and keep the main runners at the desired equidistant parallel relationship. The cross spacers also helps in keeping the main runners from moving in the longitudinal direction in relation to each other, thereby the cross spacers helps securing the right-angularity of the grid system such that the rectangular or quadratic ceiling tiles may be installed into the grid system with great accuracy.

Sometimes the grid system also comprises a plurality of cross runners extending in parallel and transverse to the main runners. In such a case the ceiling tiles may also be adapted to be supported on flanges of the cross runners.

A grid system with cross spacers is for instance known from the European patent application EP 1 154 088 A1, which basically discloses a channel shaped cross spacer provided with a plurality of slots into which a plurality of parallel main runners are inserted. The main runners are provided with apertures in their upright extending web. Fastening clips are provided and are adapted to be inserted through the apertures and thereby force the main runners upwardly relative to the cross spacer to the bottom of the slot in the cross spacer by forcing the upper edge of the aperture away from the bottom of the channel shaped cross spacer. One feature associated with this design is that there has to be enough space above the grid system to make it possible for the installer to put his hand above the edge of the channel shaped cross spacer and to reach down into the channel shaped cross spacer to put the fastening clip into place. It would be desirable that there is space above the grid system sufficient for the installer to be able to look down into the channel shaped cross spacer such that he can see the aperture into which the fastening clip is to be inserted.

However, in many cases it is desirable to make the most use of the available height of the structural ceiling, i.e. the suspended ceiling should be placed close to the structural ceiling, thereby making it difficult or even impossible to provide sufficient space for the installer.

Since the cross spacer is located above the main runners, the space required for the installer to be able to insert the clips often defines the minimum distance between the structural ceiling and the suspended ceiling.

SUMMARY

Thus, it is an object of the invention to provide an alternative solution making it possible to, when desired, put the suspended ceiling close to the structural ceiling and still offering the structural stability provided by the use of cross spacers.

This has in accordance with the invention been achieved by a grid system for a suspended ceiling, the grid system comprising at least one main runner comprising an aperture, at least one cross spacer comprising a slot, and a fixing element. Said at least one main runner is insertable into the slot in said at least one cross spacer from a first side of said at least one cross spacer such that, when the main runner is inserted into said slot, the aperture of the main runner is at least partly accessible from a second side of said at least one cross spacer inside the channel shaped cross spacer, the second side being opposite to the first side. Said at least one cross spacer further comprises an aperture, and the fixing element is adapted to, in a locked position, extend through the aperture in the main runner and through the aperture in the cross spacer such that the relative position of the main runner and the cross spacer is fixed.

The invention may be applicable to provide a grid system for other uses than for suspended ceilings but it is especially suitable for suspended ceilings and the advantages of the invention will be presented in connection with its use as a grid system for a suspended ceiling.

This basic design makes it possible for the installer to manuever the fixing element from beneath the suspended ceiling. The cross spacer is shaped as a channel with the slot formed from the bottom side of the channel. Such a shaped cross spacer is in itself a structurally relatively rigid profile. It also provides a slot with two transversely separated abutment edges for the main runner, thereby providing a rigid and distinct engagement with the main runner facilitating the installer to provide a right-angled grid system. The bottom of the channel may be used to provide a self-adjusting guidance or centring of the fixing element and thereby also of the aperture of the main runner. This will aid the installer to have all the main runners in the same longitudinal position which in turn will aid the installer in providing a right-angled grid system.

Thereby there is no longer any need to provide the same level of access to the upper side of the cross spacer and the suspended ceiling may be arranged closer to the structural ceiling compared to the prior art solution. In one embodiment the fixing element may be placed in a non-locked position before the cross spacer is put into place above the main runners and then be manuevered into a locked position. In another embodiment the fixing element may be insertable through the aperture of the cross spacer from the first side of the cross spacer. With such a design it is possible to install the fixing element completely from beneath the suspended ceiling. When the main runner is inserted in the slot, the aperture in the main runner need not be fully accessible but need only be accessible to such an extent that the fixing element is insertable into the aperture. Moreover, when the main runner is locked in its fully inserted position into the slot, the aperture need not be fully accessible or even be completely on the second side of the cross spacer; it may e.g. still also be accessible on the first side of the cross spacer.

One further advantage of the present invention is that it facilitates demounting or adjustment of the grid system since the fixing element is accessible from the underside side of the grid system. The basic design is also advantageous since it allows the fixing element to be installed and locked and then unlocked and demounted several times without being worn or deformed such that the function deteriorates. Nor will the cross spacer or main runner be subject to any wear or deformation such that its function deteriorates.

In a preferred embodiment the grid system comprises two or more main runners and the cross spacer comprises two or more slots wherein said two or more main runners each is inserted into a respective slot and each is fixed by a respective fixing element such that the relative position of each main runner and the cross spacer and thereby the relative positions of the main runners are fixed.

The aperture of the cross spacer may have a first elongated portion having at least a component of its extension extending in the longitudinal direction of the cross spacer. Such a design facilitates the insertion of the fixing element into the aperture of the main runner, preferably by allowing the fixing element to slide in said first elongated portion.

The aperture of the cross spacer may have a second elongated portion being inclined in relation to the first elongated portion and having at least a component of its extension extending in the transverse direction of the cross spacer. Such a design facilitates the locking of the fixing element into a locked position, preferably by allowing a portion of the fixing element to slide or rotate or otherwise move in said second elongate portion.

Preferably the connection between the two elongate portions is located closer to the slot than the most remote part of the first elongate portion. Most preferably the connection between the two elongate portions is located in the part of the first elongate portion being closest to the slot.

In a preferred embodiment the aperture of the cross spacer is generally L-shaped. Preferably, the two shanks of the L-shaped aperture are right-angled.

The aperture of the cross spacer may at least partly be formed in a portion of the cross spacer having at least a component of its extension in a plane parallel with a plane defined by the grid system. This way the fixing element is accessible and visible from beneath the suspended ceiling.

The cross spacer is shaped as a channel and is preferably generally U- or V-shaped, with the slot formed from the bottom side of the channel. As mentioned such a shaped cross spacer is in itself a structurally relatively rigid profile. It also provides a slot with two transversely separated abutment edges for the main runner, thereby providing a rigid and distinct engagement with the main runner facilitating the installer to provide a right-angled grid system. The bottom of the channel may be used to provide a self-adjusting guidance or centring of the fixing element and thereby also of aperture of the main runner. This will aid the installer to have all the main runners in the same longitudinal position which in turn will aid the installer in providing a right-angled grid system.

In a preferred embodiment the slot or slots are formed transverse to the longitudinal direction of the cross spacer.

The fixing element may comprise two portions, a first portion adapted to extend through the aperture of the main runner, and a second portion adapted to extend through the aperture of the cross spacer. This way the cross spacer and the main runner may be fixed to each other with the use of the first portion and the fixing element may be maneuvred with the use of the second portion accessible through the aperture of the cross spacer. Preferably the two portions are angled relative to each other. This way the second portion will form a handle e.g. facilitating sliding of the fixing element into the aperture of the main runner. It will also facilitate applying other motions, such as rotation or inclination of the first portion to provide a tensioning or the like between the cross spacer and main runner to provide the desired fixing of the cross spacer to the main runner. This also makes it easy to use the second portion as a part of a locking mechanism preventing the first portion from being accidentally removed from the aperture of the main runner.

The first portion may be adapted to engage with the second side of the cross spacer, preferably on both sides of the slot, and may be provided with one or more eccentric portions adapted to engage with the main runner, preferably the edge of the aperture of the main runner. This makes it possible to provide a strong engagement between the cross spacer and main runner. Moreover, the eccentric portion may be used to forcefully push the main runner to the bottom of the slot, thereby secure the main runner into well-defined position. The cutting of the slot is a manufacturing step which may be performed with tight tolerances.

The fixing element may be adapted to be inserted into the aperture of the main runner, to be rotated such that it engage with the second side of the cross spacer, preferably on both sides of the slot, and with the main runner, preferably the edge of the aperture of the main runner, and to be rotated such that the greatest distance between the second side of the cross spacer and the aperture of the main runner has been surpassed by an eccentric portion as the fixing element has reached its locked position. By designing the fixing element such that an eccentric portion passes the greatest distance between the second side of the cross spacer and the aperture of the main runner, the fixing element will become self-contained in the locked position. Moreover, the installer will experience a snap over or over-the-centre feed-back when turning the fixing element, thereby knowing that the fixing element is in its locked position. It may be noted that preferably the maximum distance is achieved with elastic deformation of the different elements in the engagement; the main runner, the cross-spacer and/or the fixing element, and that there is preferably still a tension in the engagement between the main runner and cross spacer on one hand and between the fixing element and the cross spacer and main runner on the other hand.

The second portion may be adapted to extend with a least a component in a transverse direction of the cross spacer when the fixing element is in its locked position, and preferably to abut the first side of the cross spacer. This way further rotation of the fixing element is securely prevented.

The fixing element may further comprise a third portion connected to the second portion and adapted to extend with at least a component in a longitudinal direction of the cross spacer when the fixing element is in its locked position, and preferably to abut the first side of the cross spacer when the fixing element is in its locked position. This will make it easy for the installer to securely rotate the fixing element in the desired manner.

The second portion of the fixing element extends with at least a component in a radial direction in a first angle position and wherein said one or more eccentricities of the first portion are formed with at least one eccentricity, preferably all eccentricities, at a second angle position, being different from the first angle position, as viewed along the first portion as axis of rotation. This makes it possible to design to which extent the eccentricity has passed its maximum eccentricity as the fixing element reaches its locked position.

BRIEF DESCRIPTION OF THE DRAWINGS

The invention will by way of example be described in more detail with reference to the appended schematic drawings, which shows a presently preferred embodiment of the invention.

DETAILED DESCRIPTION OF EXAMPLE EMBODIMENTS

Figure 1:
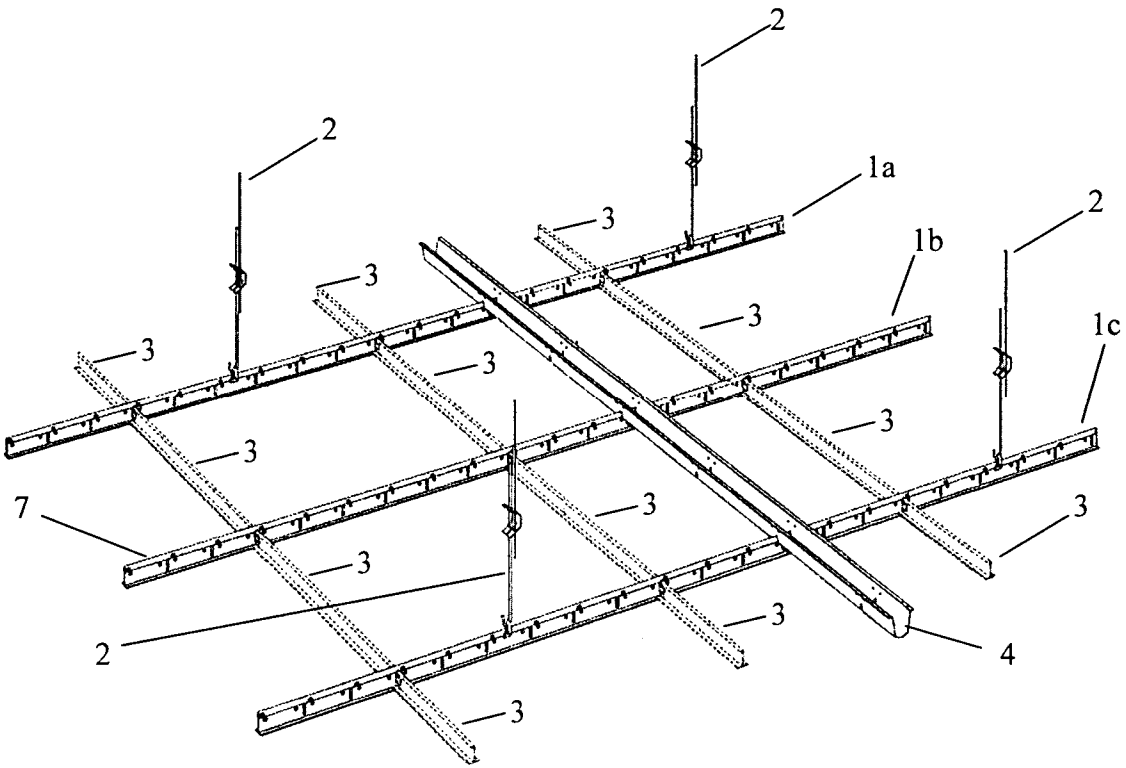
FIG. 1 discloses a portion of a suspended ceiling.

FIG. 1 discloses a typical grid system of a suspended ceiling. The grid system comprises basically a plurality of main runners 1*a*, 1*b*, and 1*c*. The main runners 1*a-c* are commonly suspended from the structural ceiling or building frame work or the like. The suspension may e.g. be provided using hangers 2 formed of wires or interconnected plate shaped members or the like. The main runners 1*a-c* are commonly arranged equidistantly and parallel to each other.

The grid system further comprises a plurality of cross runners 3 extending between the main runners 1*a-c*. The cross runners 3 are provided with connecting members at their respective ends and engage with the main runners 1*a-c*. They may also be supported by the main runners 1*a-c*. The cross runners 3 are commonly arranged equidistantly and parallel to each other, and commonly transverse to the main runners 1*a-c*.

The grid system thus formed provides a plurality of quadratic or rectangular openings into which the ceiling tiles are adapted to be placed. The ceiling tiles may have sound-absorbing and/or sound-insulation properties in order to improve the acoustic environment of a room. In order to obtain a relatively lightweight ceiling with satisfactory sound absorption, the tiles may for instance be made of a fibre material such as mineral wool and preferably of glass wool.

The main runners 1*a-c* and cross runners 3 may have a generally inverted T-shaped profile, wherein the flanges are adapted to provide support surfaces for the ceiling tiles. The ceiling tiles may rest upon the flanges with their lower major surface or with specific kerfs cut into the side surfaces of the ceiling tiles. The ceiling tiles may rest upon some or all of the flanges in respective opening in the grid system. There exist numerous variants of how to design the ceiling tiles and the kerfs in the different side surfaces. These variants are well-known to the skilled person and will not be described in detail. Furthermore, the present invention is useful for most, if not all, of these variants as long as the installment of the ceiling tiles allows the existence of a further runner or profile above the ceiling tiles.

FIG. 1 also discloses a cross spacer 4 extending across the main runners 1*a-c*. It may extend over only two main runners. In a preferred embodiment it extends over five main runners. It is also conceivable that it extends over three or four main runners, or over more than five main runners.

Figure 2:
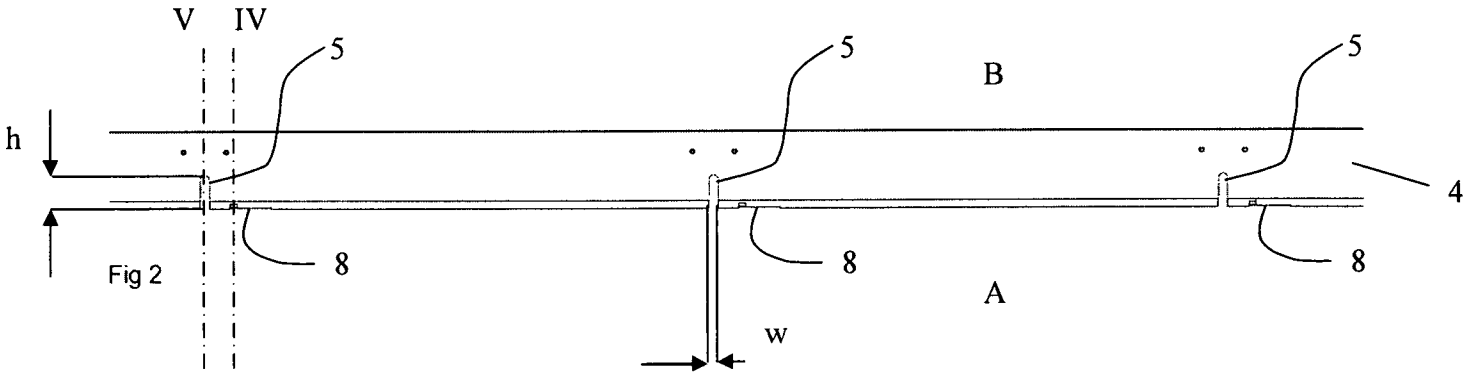
FIG. 2 discloses a cross spacer as viewed from the side.
Figure 4:
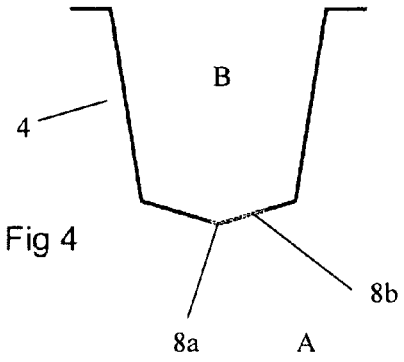
FIG. 4 discloses a cross section, along line IV-IV in FIGS. 2 and 3, of a cross spacer.
Figure 5:
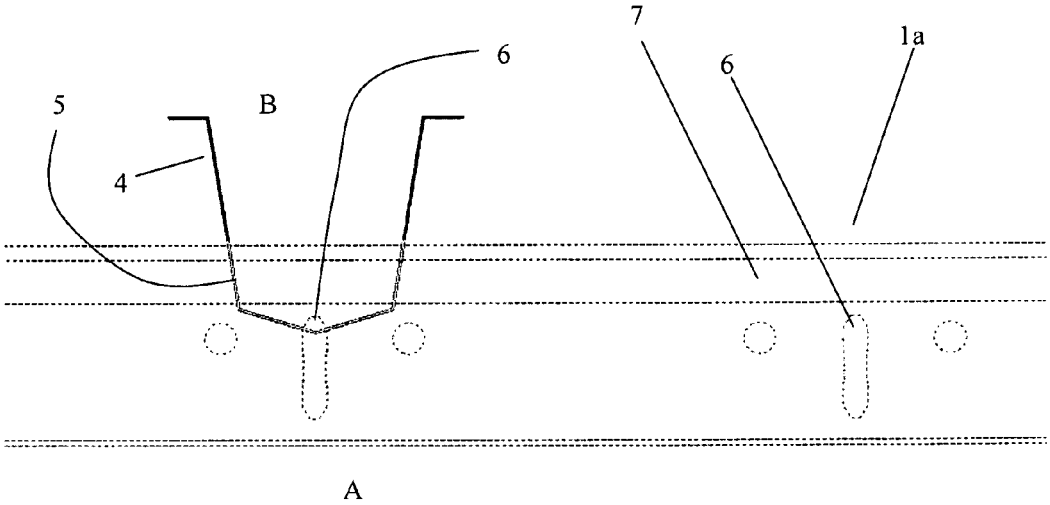
FIG. 5 discloses a cross section, along line V-V in FIGS. 2 and 3, of a cross spacer.

As disclosed in FIG. 2, the cross spacer 4 is provided with a plurality of slots 5 into which the main runners 1*a-c* are adapted to be inserted. As shown in FIGS. 1, 4 and 5, the cross spacer 4 has a generally channel shaped form. The channel is in the preferred embodiment formed as a V-shape with two portions of different inclinations. The bottom portion of the V is formed as a relatively flat or open V. The top portion of the V is formed as a relatively pointy V shape. At the uppermost portion of the V shape the cross spacer 4 is provided with a flange folded outwardly. This shape provides a cross spacer 4 which is rigid against bending, i.e. it will not sag down between its suspension points and it will extend in its longitudinal direction along a straight line.

Figure 6:
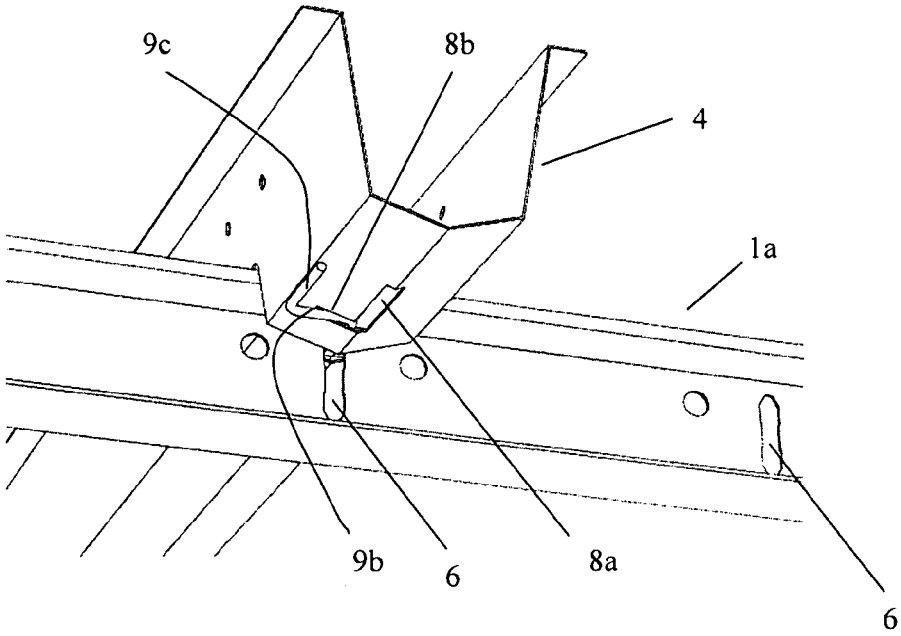
FIG. 6 discloses in perspective a cross spacer and a main runner in their locked position as viewed from beneath the suspended ceiling.
Figure 7:
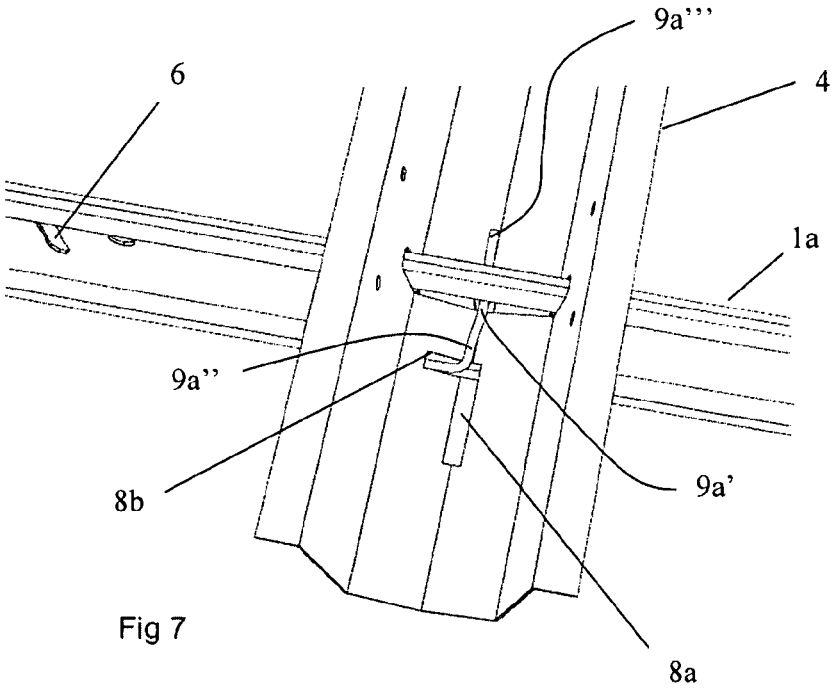
FIG. 7 discloses in perspective a cross spacer and a main runner in their locked position as viewed from above the suspended ceiling.

As shown in FIGS. 2 and 5, the slots 5 of the cross spacer 4 are straight cut-outs extending from the bottom of the channel shaped cross spacer 4 to a given height h. The height h is chosen such that apertures 6 in the main runners 1*a-c* will become accessible inside the channel shaped cross spacer 4. The apertures 6 are formed in the web portion of the inverted T-shaped profiles. This is shown in FIGS. 5 and 7. The width w of the slots 5 is chosen such that the top portion 7 of the main runners 1*a-c* fits closely into respective slot 5. The width w of the slots 5 may e.g. be adapted to accommodate the bulb commonly found at the top portion of the web of the inverted T-profile. This is shown in FIG. 6. The slots 5 are formed transverse to the longitudinal direction of the cross spacer such that a main runner 1*a-c* inserted into a slot 5 will extend in the transverse direction T of the cross spacer 4. As shown in e.g. FIGS. 4 and 5, the main runner 1*a-c* is adapted to be inserted into the slot 5 from a first side of the cross spacer 4, the first side being indicated with the encircled A. This side will in a suspended ceiling be the underside. When the main runner 1*a-c* has been inserted into the slot 5, the aperture 6 of the main runner 1*a-c* is accessible from the second side of the cross spacer 4, the second side being indicated with the encircled B. This side will in a suspended ceiling be the top side.

As shown in FIGS. 2-7, the cross spacer 4 further comprises a plurality of apertures 8. In the preferred embodiment the each of the apertures 8 is associated with a respective slot 5. The apertures 8 are arranged close to respective slot 5. A fixing element 9 is adapted to extend through the aperture 6 in the main runner 1*a-c* and through the aperture 8 in the cross spacer 4 and thereby fix the relative position of the main runner 1*a-c* and the cross spacer 4. The fixing element 9 can be inserted through the aperture 8 of the cross spacer 4 from the first side A of the cross spacer 4, i.e. when applied in a suspended ceiling it can be inserted from beneath.

Figure 3:
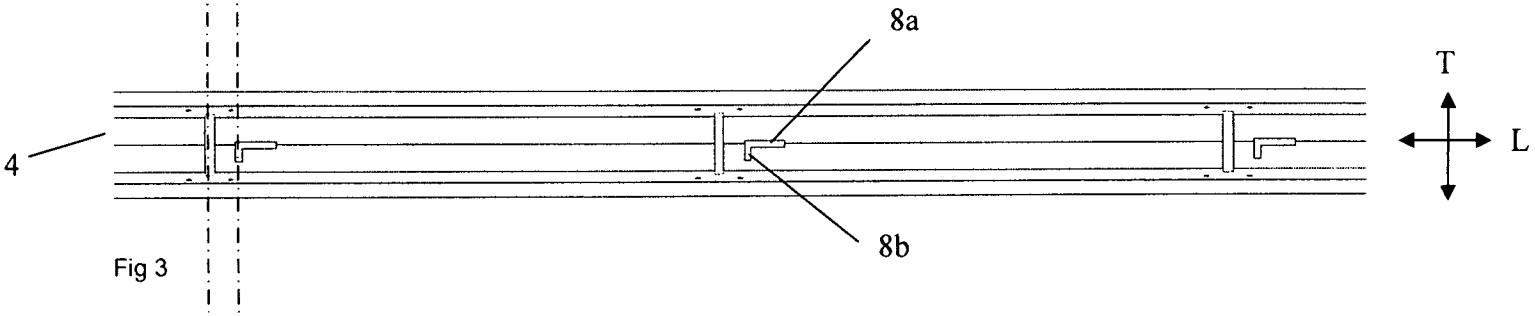
FIG. 3 discloses a cross spacer as viewed from beneath.

As shown in FIG. 3, the aperture 8 is generally L-shaped and has one shank 8*a* extending in the longitudinal direction L of the cross spacer 4 and one shank 8*b* extending in the transverse direction T of the cross spacer 4. The width of the aperture 8 is sufficient for the fixing element 9 to be moveable along the aperture 8. The longitudinally extending portion 8*a* of the aperture 8 allows the fixing element 9 to be extend through the aperture 8 and to be moved in a first direction and thereby be inserted into the aperture 6 being accessible at the second side of the cross spacer 4. The transversally extending portion 8*b* of the aperture 8 allows the fixing element 9 to be moved or turned in a second direction, being different from the first direction, which may be used to provide a locking effect preventing the fixing element 9 from accidentally being removed from the aperture 6 by a motion in a direction being opposite to the first direction. It should be noted that also other designs of the aperture 8 are possible. The L-shape may e.g. be slanted such that one or both of the shanks differ from the longitudinal and the transverse direction, respectively. Other shapes of the aperture are also conceivable. It is however preferred that the aperture 8 of the cross spacer 4 has a first elongated portion having at least a component of its extension extending in the longitudinal direction L of the cross spacer 4. This portion of the aperture 8 facilitates the insertion of the fixing element 9 into the aperture 6 of the main runner 1*a-c*. It is also preferred that the aperture 8 of the cross spacer 4 has a second elongated portion being inclined in relation to the first elongated portion and having at least a component of its extension extending in the transverse direction T of the cross spacer. This portion of the aperture 8 may be used to provide a locking effect preventing the fixing element 9 from accidentally being removed. The aperture 8 is formed in the bottom of the channel shaped cross spacer 4.

The fixing element 9 is generally shaped as a crank. It has a first portion 9*a* which is adapted to extend through the aperture 6 of the main runner 1*a-c*. It has a second portion 9*b* extending in an angle in relation to the first portion 9*a*. In the preferred embodiment the second portion 9*b* extends essentially right-angled to the first portion 9*a*. The second portion 9*b* is adapted to extend through the aperture of the cross spacer. The fixing element 9 further comprises a third portion 9*c*. This third portion 9*c* extends in an angle in relation to the second portion 9*b*, preferably essentially right-angled to the second portion 9*b*. The first portion 9*a* and the third portion 9*c* extend essentially in parallel to each other. This gives that the third portion 9*c* will extend along the surface of the cross spacer 4 and it the locked position the third portion 9*c* will essentially extend in abutment with or closely to the outside surface of the cross spacer 4. In a preferred embodiment it is formed of a sufficiently thick and rigid metallic wire which has been plastically bent to the desired crank shape. It may of course be produced using other materials.

Figure 10:
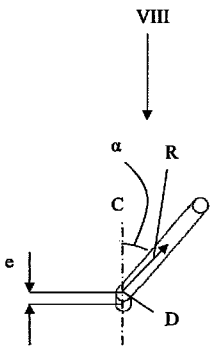
FIG. 10 discloses a fixing element as viewed from an end.
Figure 9:
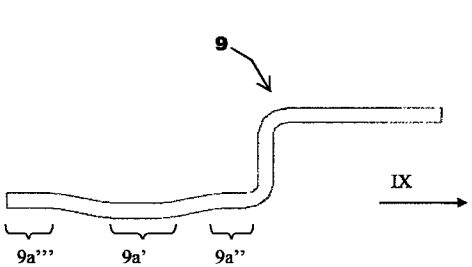
FIG. 9 discloses a fixing element, as viewed in a second angle position as indicated by arrow IX in FIG. 10.
Figure 8:
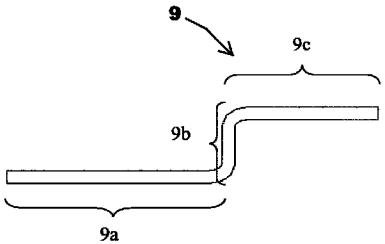
FIG. 8 discloses a fixing element, as viewed in a first angle position indicated by arrow VIII in FIG. 10.

The first portion 9*a* is adapted to engage with the second side of the cross spacer 4. It rests at the bottom of the channel and may be rotated by moving the second portion 9*b* in a sweeping movement. The first portion 9*a* is provided with an eccentric portion 9*a*'. The eccentric portion 9*a*' is located at the centre of the first portion 9*a*. The first portion 9*a* has two non-eccentric portions 9*a*" and 9*a*'", one on each side of the eccentric portion 9*a*'. These two non-eccentric portions 9*a*", 9*a*'" will engage with the cross spacer 4, one on each side of the slot 5. The eccentric portion 9*a*' will engage with the main runner 1*a-c*. The eccentric portion 9*a*' will extend through and engage with the edge of the aperture 6 of the main runner. When viewed from the end, the second portion 9*b* extends from the first portion 9*a* in an angle α relative to the axis A defined by the centre points of the eccentric portion 9*a*' and the non-eccentric portions 9*a*" and 9*a*'". This is shown in FIG. 10. This angle α is about 40°. The exact choice of this angle is dependent upon the shape of the cross spacer and especially of the inclination of the surface which the second portion 9*b* is adapted to abut when the fixing element is in its locked position. It should be noted that which portion is denoted eccentric and which is denoted non-eccentric is dependent upon the choice of co-ordinate system.

When the installer desire to fix the cross space 4 to the main runner 1*a-c*, he inserts the fixing element 9 through the aperture 8 in the cross spacer 4 into the aperture 6 of the main runner 1*a-c*. The second portion 9*b* will point essentially downwardly and the installer will be able to train the fixing element 9 through the aperture 6. Once inserted, the installer rotates the fixing element by giving the second and third portions 9*b*, 9*c* a sweeping motion. Since the first portion 9*a* has off-centre or eccentric portions this rotation will give that the distance between the bottom of the cross spacer 4 and the upper edge of the aperture 6 must be larger than the distance had to be when the fixing element 9 was initially trained through the aperture 6. As the installer continues and rotates the fixing element 9 the maximum eccentricity will occur and then the fixing element 9 is rotated slightly past this angle of maximum eccentricity until the second portion 9*b* abuts the edge of the aperture 8 or the outside surface of the cross spacer 4 and/or until the third portion 9*c* abuts the outside surface of the cross spacer 4. Since the maximum eccentricity has been surpassed, the installer will receive a feed-back in that the fixing element 9 has a tendency to snap towards the locked position once it has passed the maximum eccentricity. Moreover, this passing over the maximum eccentricity will also keep the fixing element 9 in its locked position.

The fixing element 5 is formed of a steel wire having a thickness of about 2 mm in diameter. The first portion 9*a* has a length of about 25-40 mm, preferably about 33 mm. The non-eccentric portions 9*a*" and 9*a*'" has a length of about 4-10 mm and about 4-10 mm, respectively. The eccentric portion 9*a*' has a length of about 4-10 mm, preferably 6 mm. The eccentric portion 9*a*' is eccentric a distance e of about 1-2 mm relative to the axis of the non-eccentric portions 9*a*" and 9*a*'". The transitions between the eccentric and non-eccentric portions are about 8 mm each. The second portion 9*b* has a length of about 15 mm. The third portion 9*c* has a length of about 22 mm.

The angle α is about 30-50°, preferably about 40°. The bottom portion of the channel shaped cross spacer has an inclination of about 15-20°

The second portion 9*b* of the fixing element 9 will extend close to horizontally when the fixing element is in its locked position. This is beneficial e.g. since it will not affect the positioning of the ceiling tiles. The second portion 9*b* will extend along and partly within and partly outside the transverse portion 8*b* of the aperture 8 in the cross spacer 4.

When the second portion 9*b* abuts and rests along the first side of the channel shaped cross spacer 4, the eccentric portion 9*a*' has passed its maximum point by about 50°.

The L-shaped aperture 8 in the cross spacer comprises a first portion 8*a* extending in the longitudinal direction, the first portion 8*a* having a length of about 24 mm. The L-shaped aperture 8 in the cross spacer comprises a second portion 8*b* extending in the transversal direction, the second portion 8*b* having a length of about 12 mm.

It is contemplated that there are numerous modifications of the embodiments described herein, which are still within the scope of the invention as defined by the appended claims.

For instance the cross spacer 4 may have other shapes than the disclosed channel shape with two portions of different inclinations. It may e.g. be a straight V-shaped channel with the same inclination of the sides all the way. It may e.g. be provided with more than two different inclinations. It may e.g. be designed with or without the upper horizontal flanges.

The fixing element may also be designed differently; it may e.g. be designed with two eccentric portions separated by a central non-eccentric or less eccentric portion, which may be used to engage with the edge of the aperture in the main runner, thereby aiding in keeping the fixing element in place from accidental movement along longitudinal direction of the first portion of the fixing element.

The fixing element may also be designed with only the first and the second portions.

The third portion of the fixing element may extend in an angle also in relation to the first portion. With such a design it will not be in parallel with the first portion and it will not follow the outside surface of the cross spacer. This may be used to facilitate demounting of the fixing element. On the other hand it may increase the risk for accidental removal.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A grid system for a suspended ceiling, the grid system comprising:

at least one main runner including an aperture;

at least one cross spacer including a slot, wherein the at least one cross spacer is shaped as a channel, with the slot formed from a bottom opposite an open top of the at least one channel shaped cross spacer; and at least one fixing element, wherein said at least one main runner is insertable into the slot in said at least one cross spacer from a first side of said at least one cross spacer such that, when the at least one main runner is inserted into said slot, the aperture of the at least one main runner is at least partly accessible from a second side of said at least one cross spacer inside the channel shaped cross spacer, the second side being opposite to the first side, wherein said at least one cross spacer further includes an aperture, and wherein the at least one fixing element is adapted to, in a locked position, extend through the aperture in the at least one main runner and through the aperture in the at least one cross spacer such that the relative position of the at least one main runner and the at least one cross spacer is fixed; wherein the at least one fixing element is insertable through the aperture of the at least one cross section from the first side of the at least one cross spacer.

2. The grid system according to claim 1, wherein the at least one main runner includes two or more main runners, wherein the at least one cross spacer comprises two or more slots and wherein said two or more main runners each are inserted into a respective one of the two or more slots and wherein each of said two or more main runners is fixed by a respective one of the at least one fixing element such that the relative position of each main runner and the at least one cross spacer and thereby the relative positions of the main runners is fixed.

3. The grid system according to claim 1, wherein the aperture of the at least one cross spacer has a first elongated portion having at least a portion of the aperture extending in the longitudinal direction of the at least one cross spacer.

4. The grid system according to claim 3, wherein the aperture of the at least one cross spacer has a second elongated portion being inclined in relation to the first elongated portion and having at least a portion of the aperture extending in the transverse direction of the at least one cross spacer.

5. The grid system according to claim 1, wherein the aperture of the at least one cross spacer is generally L-shaped.

6. The grid system according to claim 5, wherein the aperture of the at least one cross spacer is L-shaped with shanks existing at right-angles.

7. The grid system according to claim 1, wherein the aperture of the at least one cross spacer is at least partly formed in a portion of the at least one cross spacer extending in a plane parallel with a plane defined by the grid system.

8. The grid system according to claim 1, wherein the channel shaped at least one cross spacer is generally U- or V-shaped.

9. The grid system according to claim 1, wherein the slot is formed transverse to the longitudinal direction of the at least one cross spacer.

10. The grid system according to claim 1, wherein the at least one fixing element comprises two portions including a first portion adapted to extend through the aperture of the at least one main runner and a second portion adapted to extend through the aperture of the at least one cross spacer.

11. The grid system according to claim 10, wherein the first portion is adapted to engage with the second side of the at least one cross spacer, and is provided with one or more eccentric portions adapted to engage with the at least one main runner.

12. The grid system according to claim 11, wherein the at least one fixing element is adapted to be inserted into the aperture of the at least one main runner, to be rotated such that the at least one fixing element engages with the second side of the at least one cross spacer, and with the at least one main runner, and is adapted to be rotated such that a relatively greatest distance between the second side of the at least one cross spacer and the aperture of the at least one main runner has been surpassed by an eccentric portion as the at least one fixing element has reached a locked position.

13. The grid system according to claim 12, wherein the at least one fixing element is adapted to be inserted into the aperture of the at least one main runner, to be rotated such that the at least one fixing element engages with the second side of the at least one cross spacer on both sides of the slot, and with the edge of the aperture of the at least one main runner, and adapted to be rotated such that a relatively greatest distance between the second side of the at least one cross spacer and the aperture of the at least one main runner has been surpassed by an eccentric portion as the at least one fixing element has reached its locked position.

14. The grid system according to claim 11, wherein the first portion is adapted to engage with the second side of the at least one cross spacer on both sides of the slot, wherein the one or more eccentric portions is adapted to engage with the edge of the aperture of the at least one main runner.

15. The grid system according to claim 10, wherein the second portion is adapted to extend with a least a component in a transverse direction of the at least one cross spacer when the at least one fixing element is in its locked position.

16. The grid system according to claim 15, wherein the second portion is adapted to extend with a least a component in a transverse direction of the at least one cross spacer when the at least one fixing element is in its locked position, and to abut the first side of the at least one cross spacer.

17. The grid system according to claim 10, wherein the at least one fixing element further comprises a third portion connected to the second portion and is adapted to extend with at least a component in a longitudinal direction of the at least one cross spacer when the at least one fixing element is in its locked position.

18. The grid system according to claim 17, wherein the at least one fixing element is adapted to abut the first side of the at least one cross spacer when the at least one fixing element is in its locked position.

19. The grid system according to claim 10, wherein the second portion of the at least one fixing element extends with at least a component in a radial direction in a first angle position and wherein said one or more eccentricities of the first portion are foamed with at least one eccentricity at a second angle position, being different from the first angle position, as viewed along the first portion as axis of rotation.

20. The grid system according to claim 19, wherein said one or more eccentricities of the first portion are formed with all eccentricities at the second angle position.

* * * * *